US007433479B2

(12) United States Patent
Sato

(10) Patent No.: US 7,433,479 B2
(45) Date of Patent: Oct. 7, 2008

(54) HEADPHONE APPARATUS

(75) Inventor: Koichi Sato, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 615 days.

(21) Appl. No.: 10/740,423

(22) Filed: Dec. 22, 2003

(65) Prior Publication Data

US 2005/0117761 A1 Jun. 2, 2005

(30) Foreign Application Priority Data

Dec. 20, 2002 (JP) ..... 2002-369837

(51) Int. Cl.
*H04R 5/02* (2006.01)

(52) U.S. Cl. ..... 381/309; 381/17

(58) Field of Classification Search ..... 381/1, 381/17–18, 309–311, 312, 19, 74
See application file for complete search history.

(56) References Cited

U.S. PATENT DOCUMENTS

| | | | | |
|---|---|---|---|---|
| 5,579,396 | A * | 11/1996 | Iida et al. | 381/18 |
| 6,486,985 | B1 * | 11/2002 | Bischoff et al. | 398/185 |
| 6,801,627 | B1 * | 10/2004 | Kobayashi | 381/17 |
| 6,846,985 | B2 * | 1/2005 | Wang et al. | 174/391 |
| 6,990,205 | B1 * | 1/2006 | Chen | 381/17 |
| 7,076,068 | B2 * | 7/2006 | Sotome et al. | 381/17 |
| 7,082,203 | B1 * | 7/2006 | Drakoulis et al. | 381/77 |
| 2001/0012367 | A1 * | 8/2001 | Sotome et al. | 381/1 |
| 2002/0034307 | A1 * | 3/2002 | Kubota | 381/17 |
| 2004/0120530 | A1 * | 6/2004 | Sapashe et al. | 381/58 |
| 2004/0133312 | A1 * | 7/2004 | Watanabe et al. | 700/264 |
| 2006/0045274 | A1 * | 3/2006 | Aarts et al. | 381/17 |

* cited by examiner

*Primary Examiner*—Vivian Chin
*Assistant Examiner*—Disler Paul
(74) *Attorney, Agent, or Firm*—Young & Thompson

(57) ABSTRACT

A headphone apparatus is presented so that a sound image of game sound outputted from an on-line game machine having a communication function is localized at one or more positions out of the head of the listener wearing a headphone while a sound image of an opponent player's voice outputted from the game machine is localized at a position in the head of the listener.

17 Claims, 10 Drawing Sheets

HEADPHONE APPARATUS

BACKGROUND OF THE INVENTION

1. Field of the Invention

The present invention relates to a headphone apparatus used for listening to sound such as game sound, music, human voice and so on.

2. Description of the Related Art

There are presented game machines capable of making access to a communication network such as Internet, and allowing the user to enjoy the game with transmitting and receiving information via the communication network. These game machines are generally called on-line game machines. In conventional game machines, a person who plays a game (hereinafter called a "player") plays a game with a game machine, otherwise two or more players come together at a place to play a game with a game machine. On the contrary, according to on-line game machines, two or more players who are at different places from each other can enjoy a same game with their own game machines. For example, two players who are at different places can play against each other in a same game, or two or more players who are at various places can participate in a same game.

Some on-line game machines have a function that allows multiple players to make a conversation or chat one another via a communication network (hereinafter this function is called a "voice communication function"). For example, using the voice communication network may allow a voice exchange between a player and an opponent player during the game. More specifically, each player wears a microphone-attached-headphone arranged so that the microphone and the headphone are integrated as a unit. If one player says something, the player's voice is supplied to the on-line game machine via the microphone of the microphone-attached-headphone. Then it reaches an on-line game machine of another player (opponent) and further reaches the ears of the opponent via the microphone-attached-headphone that the opponent wears. This voice exchange may be bidirectional.

On the other hand, game machines typically integrate music reproduction devices therein for a function to reproduce sound such as music, sound effect, game character's voice and the like, which are recorded in a ROM disc, a built-in hard disk or the like (hereinafter these sound information is generally called "game sound"). The game sound is reproduced in association with the game content.

Thus, in the on-line game machine with the voice communication function, the player can enjoy the game while listening to both of the opponent's voice and the game sound. In this case, usually, the opponent's voice reaches the ears of the player via the own microphone-attached-headphone, while the game sound is outputted to an ambient (e.g. in a room) via speakers connected to the on-line game machine. For example, since on-line game machines are typically connected to televisions, the game sound is outputted from speakers disposed at televisions. In order to enjoy more sophisticated game sound, on-line game machines may be connected to audio systems to output the game sound from large speakers disposed at the audio systems.

Nevertheless, in the on-line game machine with the voice communication function, the game sound may arise a noise issue, since the game sound is outputted from speakers of the television, the audio system or the like into the ambient such as into the room or the like. For example, if a resident of an apartment plays a game with a full volume in the mid-night, the neighbors may be annoyed by the game sound as noise.

As a solution, it seems advantageous to present an arrangement in which not only the opponent's voice but also the game sound is supplied to the headphone to be outputted only to the ears of the player.

If a simple composition of the voice and the game sound is outputted from speakers, however, the voice and the game sound are mixed in a same sound field. As a result, a problem is arisen, that is the player can not clearly distinguish the voice and the game sound. For example, if the opponent's voice is merged into the game sound, the player may fail to play or enjoy some contents of the game or games.

This problem may arise not only in the game machines but also in various machines or apparatus. That is, this problem may arise in various machines or apparatuses designed so that two or more sound are combined or synthesized to be outputted via the headphone. For example, in an apparatus with a function for listening to sound via a headphone, the sound being obtained by synthesizing music outputted from a CD player or the like and sound outputted from a cell phone (phone ring and voice of the party of the other end), the listener can not clearly distinguish the sound outputted from the CD player or the like and the sound outputted from the cell phone, which is inconvenient. For example, if the phone ring or the voice of the party of the other end merges into the music outputted from the CD player, it is difficult to talk on the line.

SUMMARY OF THE INVENTION

It is therefore an object of the invention to provide a headphone apparatus allowing the listener to clearly distinguish two or more kinds of sound.

It is a second object of the invention to provide a headphone apparatus for a game purpose allowing the listener to clearly distinguish game sound and voice of the other player.

The above object is achieved by a headphone apparatus according to the present invention. The headphone apparatus is provided with: two or more input devices including at least a first input device and a second input device for inputting sound generation device; a first localization device for localizing a sound image of the sound signal, which is inputted into the first input device, at one or more positions out of a head of a listener; a synthesis device for synthesizing the sound signal whose sound image is localized by the first localization device and sound generation device that is inputted into the second input device; and an output device for outputting the sound signal that is synthesized by the synthesis device.

The above second object of the invention is achieved by a headphone apparatus for a game purpose according to the present invention. The headphone apparatus is provided with: two or more input devices including at least a first input device and a second input device for inputting sound generation device; a first localization device for localizing a sound image of the sound signal, which is inputted into the first input device, at one or more positions out of a head of a listener; a synthesis device for synthesizing the sound signal whose sound image is localized by the first localization device and sound generation device that is inputted into the second input device; and an output device for outputting the sound signal that is synthesized by the synthesis device, wherein the sound signal to be inputted into the first input device is game sound.

The nature, utility, and further features of this invention will be more clearly apparent from the following detailed description with reference to preferred embodiments of the invention when read in conjunction with the accompanying drawings briefly described below.

DETAILED DESCRIPTION OF THE PREFERRED EMBODIMENTS

Embodiments of the present invention will now be discussed, with reference to drawings.

First Embodiment

Figure 1:
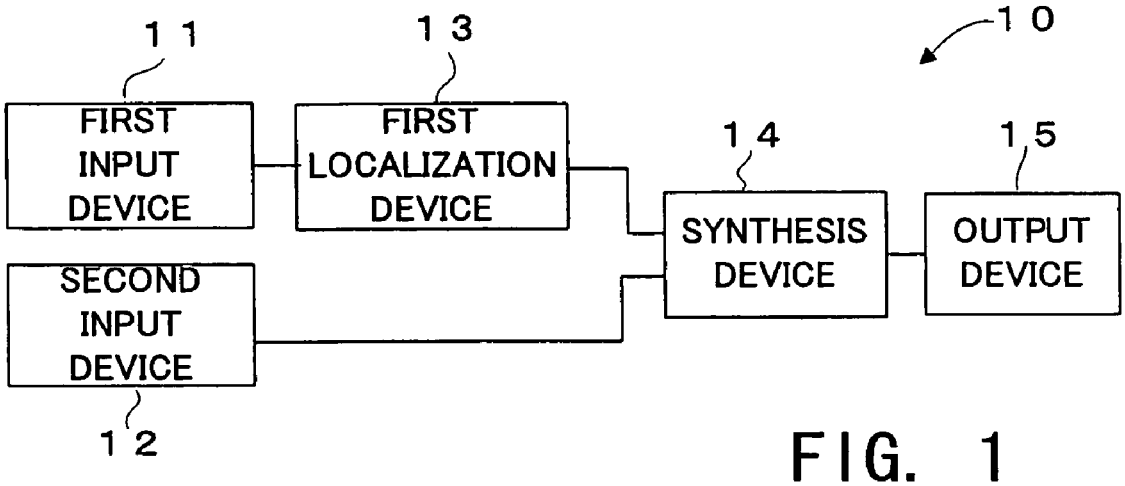
FIG. 1 is a block diagram illustrating a construction of a headphone apparatus according to a first embodiment of the present invention.

The first embodiment of the present invention will now be discussed, with reference to FIG. 1. FIG. 1 illustrates a construction of a headphone apparatus according to the first embodiment of the present invention (hereinafter referred to as a "first headphone apparatus"). Incidentally, in FIG. 1, components according to the embodiment of the present invention are embodied for an explanation of the technical concept, but not restrictive for shapes or positions of each component or the connective relationships of them. The same discussion is applied to FIG. 2 to FIG. 13, which are used for the explanation of embodiments of the present invention.

The first head phone apparatus 10 as shown in FIG. 1 is a head phone apparatus used to listen to sound such as game sound, music, human voice and so on. The first headphone apparatus 10 is provided with two or more input devices including at least a first input device 11 and a second input device 12, a first localization device 13, a synthesis device 14 and an output device 15.

The input device is for inputting sound generation device. There are disposed two or more input devices, including at least the first input device 11 and the second input device 12. The number of the input device may be three or four insofar as not less than two, but for convenience of explanation, hereinbelow the case that two input devices, i.e. the first input device and the second input device are disposed will be discussed. The sound signal is inputted into the first input device 11 and the second input device 12, respectively. The sound signal to be inputted separately into the first input device 11 and the second input device 12 may be the same or may be different to each other. The sound signal to be inputted into the first input device may be monaural sound, two-channel stereo sound, five-channel sound or other multi channel sound signal having more than five channels. The same goes for the second input device 12. That is, the number of the channel of the sound signal to be inputted individually into each input device is not restrictive.

The first input device 11 may be tangibly embodied in a terminal such as a jack or a plug. In the case that the sound signal as an analog signal is to be converted into a digital signal, an A/D (analog-digital) converter may be disposed at the first input device 11. Furthermore, in the case that other signal processing is required, a signal processing circuit as required may be disposed at the first input device 11. These specific components or their construction may also be applied to the second input device 12. The audio sound may be a signal responsive to sound such as game sound, music or human voice, regardless analog signal or digital signal.

The first localization device 13 is for locating the sound signal, which is inputted into the first input device 11, to out of a head of a listener. If the listener wears a headphone to listen to sound that is outputted from two speaker units arranged for the headphone, and the sound is just monaural sound or two-channel stereo sound, the sound is naturally sensed in the head of the listener (this state is called an "inside localization"). If the sound signal to be supplied to the speaker units arranged for the headphone is subjected to an appropriate signal processing, however, the sound that is outputted from the headphone is sensed as if it arose from out of the listener's head, for example arisen from foreside, backside or sideways of the listener's head. Thus, there is some technology of localizing the sound from the headphone to out of the head of the listener, in which the sound signal to be supplied to the headphone (this technology is called an "out-of-head sound localization") is subjected to certain signal processing (e.g. Japanese Patent Application Laid-Open No. Hei 11-557999).

Figure 2:
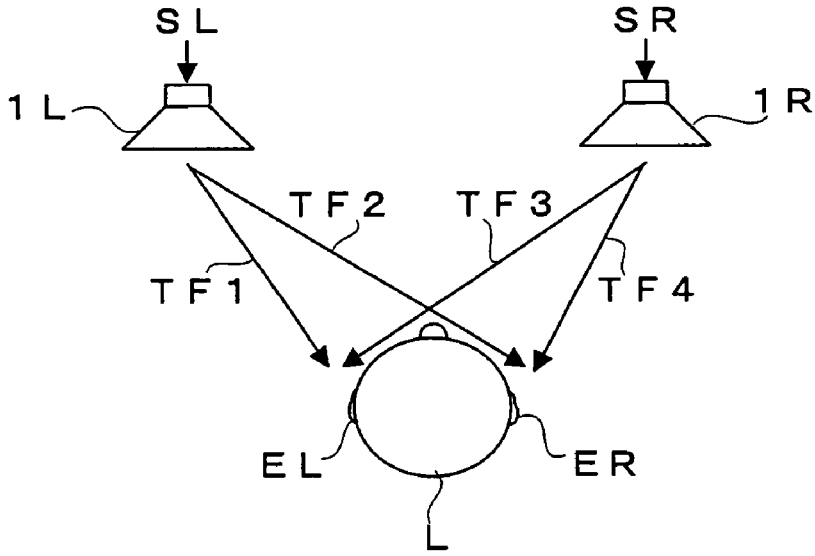
FIG. 2 is an explanation view illustrating an out-of-head sound localization.
Figure 3:
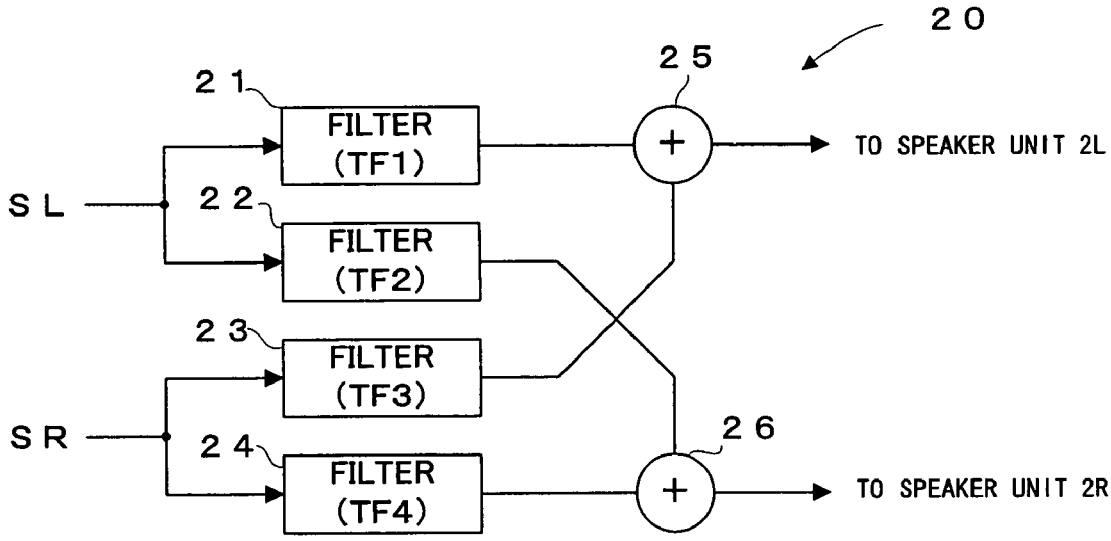
FIG. 3 is a schematic circuit diagram illustrating a circuit to embody the out-of-head localization.
Figure 4:
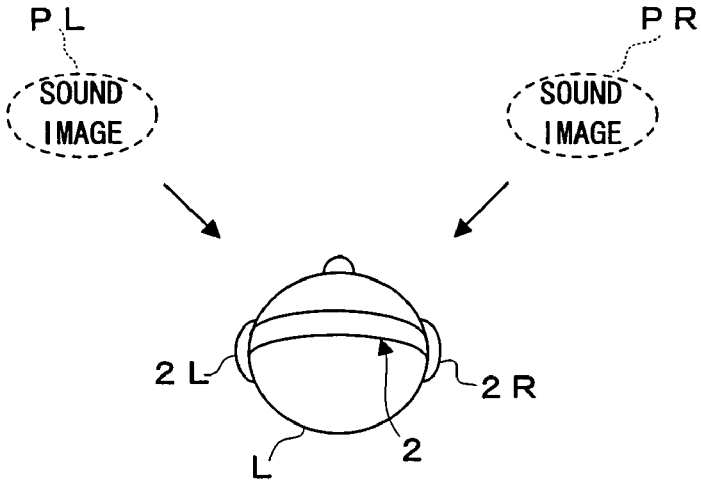
FIG. 4 is an explanation view illustrating an out-of-head sound localization.

FIG. 2 to FIG. 4 illustrate an exemplary out-of-head localization technology. In FIG. 2, a sound generating source 1L is disposed at front-left side of the listener L, and a sound generating source 1R is disposed at front-right side of the listener L. The sound generating source 1L and 1R may be speakers connected to an audio system. A sound SL is outputted from the sound generating source 1L, and a sound SR is outputted from the sound generating source 1R. Therefore, firstly, a transfer function TF1 of the sound SL from the sound generating source 1L to a left ear EL of the listener L, a transfer function TF2 of the sound SL from the sound generating source 1L to a right ear ER of the listener L, a transfer function TF3 of the sound SR from the sound generating source 1R to the left ear EL of the listener L and a transfer function TF4 of the sound SR from the sound generating source 1R to the right ear ER of the listener L are determined.

Next, a signal processing circuit 20 as shown in FIG. 3 is prepared. That is, the signal processing circuit 20 is provided with filters 21, 22, 23 and 24, and synthesizers 25 and 26. The sound signal corresponding to the sound SL is inputted into the filters 21 and 22, respectively. The sound signal corresponding to the sound SR is inputted into the filters 23 and 24, respectively. A filter coefficient based on the transfer function TF1 is assigned to the filter 21, and a filter coefficient based on the transfer function TF2 is assigned to the filter 22. A filter coefficient based on the transfer function TF3 is assigned to the filter 23, and a filter coefficient based on the transfer function TF4 is assigned to the filter 24. Furthermore, the sound signals that are outputted from the filter 21 and the filter 23, respectively are synthesized at the synthesizer 25 and then supplied in a synthesized form to a left speaker unit 2L of a headphone 2 as shown in FIG. 4. On the other hand, the sound signals that are outputted from the filter 22 and the filter 24, respectively are synthesized at the synthesizer 26 and then supplied in a synthesized form to a right speaker unit 2R of the headphone 2. Thereby, as shown in FIG. 4, if the listener L wearing the headphone 2 listens to the sound SL and SR that are outputted from the speaker units 2L and 2R of the headphone 2, respectively, a sound image of the sound SL is located at front-left side PL of the listener L, and the sound image of the sound SR is located at front-right side PR of the listener L. As a result, the listener L has an illusion as if the sound SL and SR were coming from the front-left side PL and the front-right side PR of the listener L.

Incidentally, in the example shown by FIG. 2 to FIG. 4, the case that two streams of sound are localized at two positions, i.e. at the front-left side and the front-right side out of the head of the listener is discussed. Nevertheless, this technology can be applied to the case that one or more streams of sound are localized at any one or more positions out of the head of the listener. For example, in order to give a sound field of so-called "five-channel surround" to the listener wearing the headphone, transfer functions established between each channel and each ear of the listener are determined, filter coefficients based on ten transfer functions are assigned to total ten filters, respectively, and outputs for two channels are obtained by synthesizing the outputs from the filters as appropriate to be supplied to the left speaker unit and the right speaker unit of the headphone, respectively.

The first localization device 13 of the first headphone apparatus 10 can be achieved due to an employment of the aforementioned out-of-head sound localization. Specifically, the first localization device 13 is provided with a DSP, with which the out-of-head sound localization is presented. Incidentally, the first localization device 13 may represent the aforementioned out-of-head sound localization by loading a software into a CPU (Central Processing Unit) or other circuits disposed at a general-purpose computer, instead of depending on a specific DSP.

Figure 5:
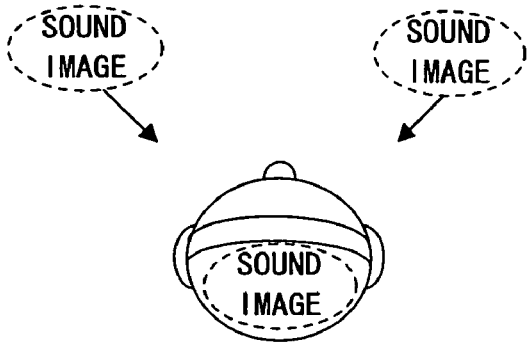
FIG. 5 is an explanation view illustrating a situation that sound images are localized in or out of the head of a listener.
Figure 6:
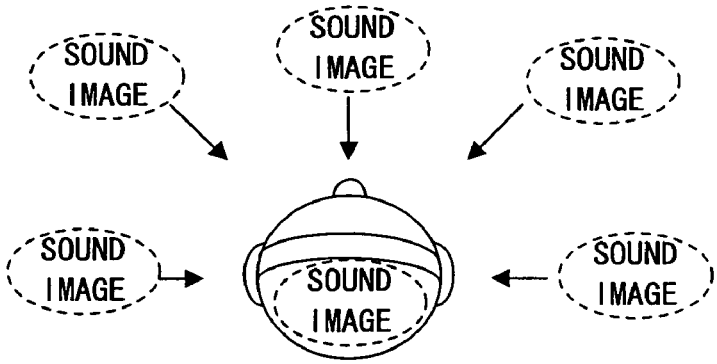
FIG. 6 is an explanation view illustrating another situation that sound images are localized in or out of the head of a listener.
Figure 7:
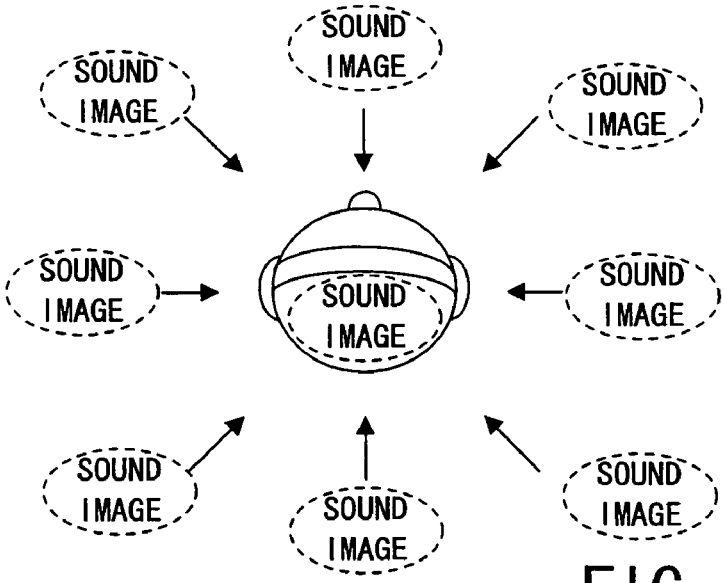
FIG. 7 is an explanation view illustrating still another situation that sound images are localized in or out of the head of a listener.

A position or positions out of the head of the listener at which the first localization device 13 localizes the sound signal inputted into the first input device 11 may be selected on the basis of the number of channels of the signal to be inputted or on the basis of a purpose or specification of the first headphone apparatus 10 or the like. For example, the first localization device 13 may be arranged to localize the sound images of the sound signals inputted into the first input device 11 at two positions out of the head of the listener. Alternatively, the first localization device 13 may be arranged to localize the sound images of the sound signals inputted into the first input device 11 at five positions out of the head of the listener. More specifically, as shown in FIG. 5, the first localization device 13 may be arranged to localize the sound images of the sound signals inputted into the first input device 11 at the positions out of the head of the listener, i.e. front-left side of the listener and front-right side of the listener. Alternatively, as shown in FIG. 6, the first localization device 13 may be arranged to localize the sound images of the sound signals inputted into the first input device 11 at five or more positions out of the head of the listener, including front-left side, center-front, front-right side, left side and right side of the listener. Furthermore, as shown in FIG. 7, the first localization device 13 may be arranged to localize the sound images of the sound signals inputted into the first input device 11 at eight or more positions out of the head of the listener, including front-left side, center-front, front-right side, left side, right side, rear-left side, center-rear and rear-right side of the listener. Alternatively, the first localization device 13 may be arrange to localize the sound images of the sound signals inputted into the first input device 11 at any one position out of the head of the listener.

Now back to FIG. 1, the synthesis device 14 is for synthesizing the sound signal that is localized by the first localization device 13 and a sound signal that is inputted into the second input device 12. The synthesis device 14 may be tangibly embodied in a mixer or the like, otherwise may be arranged to synthesize the sound signals by loading a software into a CPU or other circuits disposed at a general-purpose computer. If the sound signal outputted from the first localization device 13 or the second input device 12 is a digital signal, a D/A (Digital-Analog) converter may be disposed at an inlet area, outlet area or the like of the synthesis device 14. The sound signal outputted from the synthesis device 14 is in at least two streams (two channels).

The output device 15 is for outputting the sound signal synthesized at the synthesis device 14. The output device 15 may include a speaker unit that the listener wears on his/her ears. More specifically, the output device 15 includes a left speaker unit and a right speaker unit of the headphone. The two-channel sound signals synthesized at the synthesis device 14 are outputted to the left speaker unit and the right speaker unit of the headphone, respectively.

According to the first headphone apparatus 10 having the aforementioned configuration, as shown in FIG. 5 to FIG. 7 for example, the sound signals inputted via the first localization device 13 and the first input device 11 are localized at positions out of the head of the listener. On the other hand, the sound signal inputted via the second input device 12 is localized in the head of the listener. Thus, the sound signal inputted via the first input device 11 is localized at a position different from a position at which the sound signal inputted via the second input device 12 is localized. Therefore, even if the sound that is inputted via the first input device 11 and the sound that is inputted via the second input device are outputted from the headphone at the same time, the listener can clearly distinguish these two streams of sound.

Of course, it is possible to provide a headphone apparatus capable of clearly distinguishing three or more sound signals, by disposing three or more input devices, and supplying sound generation device, which is inputted into one of these input devices, directly into the synthesis device, supplying other sound signals, which are inputted into the rest of these input devices, into the synthesis device via the corresponding two or more localization devices, respectively, and localizing each sound image of sound signals at a different position to each other by means of each localization device.

Second Embodiment

Figure 8:
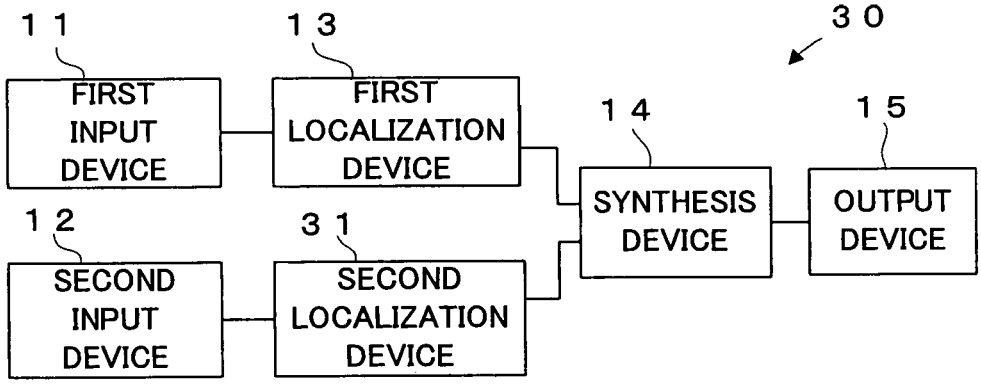
FIG. 8 is a block diagram illustrating a configuration of a headphone apparatus according to a second embodiment of the present invention.

The second embodiment of the present invention will now be discussed, with reference to FIG. 8. FIG. 8 illustrates a headphone apparatus according to the second embodiment of the present invention (hereinafter it is called "second headphone apparatus").

As shown in FIG. 2, the second headphone apparatus 30 is provided with a first input device 11, a second input device 12, a first localization device 13, a synthesis device 14 and an output device 15, similarly to the first headphone apparatus 10. The second headphone apparatus 30 is further provided with a second localization device 31.

The second localization device 31 is for localizing a sound image of sound generation device that is inputted into the second input device 12 at a position different from a position at which the first localization device 13 localizes a sound image. Similarly to the first localization device 13, the second localization device 31 can be achieved by employing the known out-of-head sound localization, and may be tangibly embodied in a DSP or the like, or may be tangibly embodied with a software.

The position of the sound image that is localized by the second localization device 31 may be any position insofar as it is different from a position of a sound image that is localized by the first localization device 13. That is, the position of the sound image that is localized by the second localization device 31 may be in the head of the listener, or may be out of the head of the listener. Alternatively, the position at which the sound image is localized may be one or more in its number.

The synthesis device 15 synthesizes the sound signal whose sound image is localized by the second localization device 31 with sound generation device whose sound image is localized by the first localization device 13 and then supplies it to the output device 15.

According also to the second headphone apparatus 30 having such a configuration, since the sound image of the sound signal that is inputted via the first input device 11 and the first localization device 13 and the sound image of the sound signal that is inputted via the second input device 12 and the second localization device 31 are localized at different positions from each other, the listener wearing the headphone can clearly distinguish these two streams of sound. Particularly, according to the second headphone apparatus 30, since it is possible to localize not only the position of the sound image of the sound signal that is inputted into the first input device 11, but also the position of the sound image of the sound signal that is inputted into the second input device 12, two or more directions of sound sources can be freely controlled. As a result, it is possible to (i) identify directions of sound sources and give meaning to the multiple sound in association with the directions of the sound sources, (ii) arise an illusion as if the sound moves over the head of the listener, or (iii) arise an illusion as if the sound moves between in and out of the head of the listener, as well as a fact that the listener can simply distinguish two or more sound.

Third Embodiment

Figure 9:
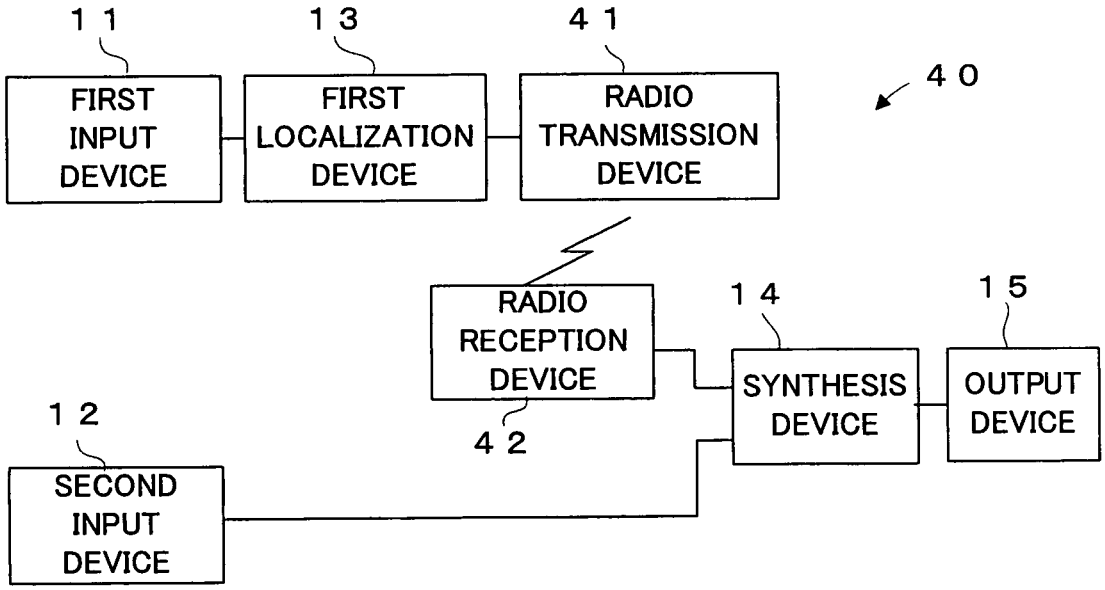
FIG. 9 is a block diagram illustrating a configuration of a headphone apparatus according to a third embodiment of the present invention.

The third embodiment of the present invention will now be discussed, with reference to FIG. 9. FIG. 9 illustrates a headphone apparatus according to the third embodiment of the present invention (hereinafter it is called a "third headphone apparatus").

As shown in FIG. 9, the third headphone apparatus 40 is provided with a first input device 11, a second input device 12, a first localization device 13, a synthesis device 14 and an output device 15, similarly to the first headphone apparatus 10. The third headphone apparatus 40 is further provided with a radio transmission device 41 for performing a radio transmission of sound generation device whose sound image is localized by the first localization device 13 and a radio reception device 42 for receiving the sound signal that is wirelessly transmitted by the radio transmission device 41 and for supplying the sound signal to the synthesis device 14. The radio transmission device 41 and the radio reception device 42 may be a transmitter and a receiver employing infrared radiation, light, radio wave, electromagnetic wave or the like. Then, they may transmit and receive a digital signal, or may transmit and receive an analog signal. Thereby, the sound signal which is inputted into the first input device 11 and whose sound image is localized by the first localization device 13 is transmitted from the radio transmission device 41. The sound signal that is wirelessly transmitted is received at the radio reception device 42, then synthesized with another sound signal inputted into the second input device 12 by means of the synthesis device 14 and then outputted in a synthesized form to the ears of the listener via the output device 15.

According to the third headphone apparatus 40 having such a configuration, since the radio transmission device 41 and the radio reception device 42 are disposed, a unit of the first input device 11, the first localization device 13 and the radio transmission device 41 and a unit of the second input device 12, the synthesis device 14, the output device 15 and the radio reception device 42 can be spatially separated. For example, the third headphone apparatus 40 may be provided with a signal processing unit of the first input device 11, the first localization device 13 and the radio transmission device 41, and a headphone unit of the second input device 12, the radio reception device 42, the synthesis device 14 and the output device 15, the signal processing unit and the headphone unit being spatially separated. Thereby, for example, different electric supply systems are employed respectively for the signal processing unit including the first localization device 13 requiring relatively high power consumption and for the headphone unit requiring relatively low power consumption. Alternatively, the signal processing unit can be embodied in a general-purpose computer, while the headphone unit is embodied in a compact headphone.

Incidentally, similarly to the second headphone apparatus 30, the third headphone apparatus 40 may further be provided with a second localization device.

Fourth Embodiment

Figure 10:
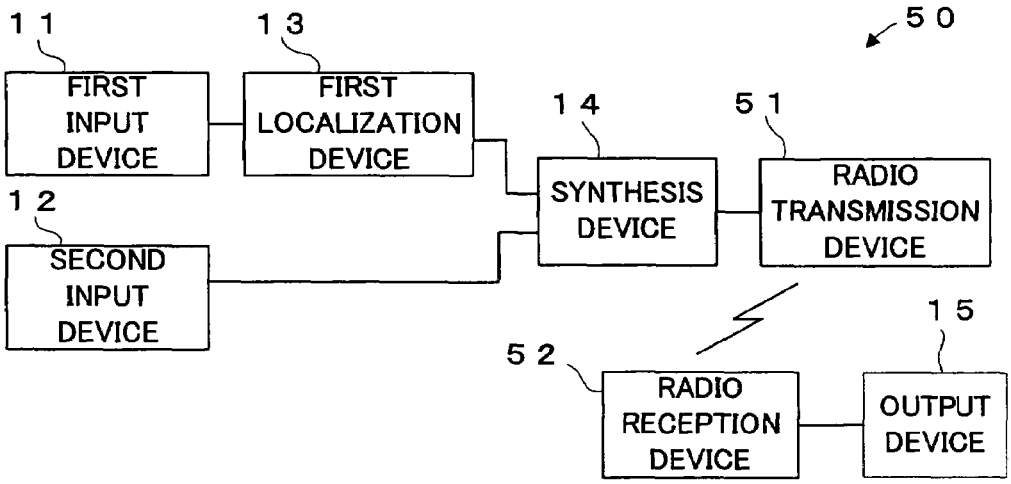
FIG. 10 is a block diagram illustrating a configuration of a headphone apparatus according to a fourth embodiment of the present invention.

The fourth embodiment of the present invention will now be discussed, with reference to FIG. 10. FIG. 10 illustrates a headphone apparatus according to the fourth embodiment of the present invention (hereinafter it is called a "fourth headphone apparatus").

As shown in FIG. 10, the fourth headphone apparatus 50 is provided with a first input device 11, a second input device 12, a first localization device 13, a synthesis device 14 and an output device 15, similarly to the first headphone apparatus 10. The fourth headphone apparatus 50 is further provided with a radio transmission device 51 for wirelessly transmitting sound generation device synthesized by the synthesis device 14, and a radio reception device 52 for receiving the sound signal wirelessly transmitted by the radio transmission device 51 and for supplying the sound signal to the output device 15. The radio transmission device 51 and the radio reception device 52 may be configured similar to the radio transmission device 41 and the radio reception device 42, respectively. Thereby, the sound signal which is inputted via the first input device 11 and whose sound image is localized by the first localization device 13 and sound generation device which is inputted via the second input device 12 are synthesized by the synthesis device 14 and then wirelessly transmitted from the radio transmission device 51. The sound signal wirelessly transmitted is received at the radio reception device 52 and then outputted to the ears of the listener via the output device 15.

According to the fourth headphone apparatus 50 having such a configuration, since the radio transmission device 51 and the radio reception device 52 are disposed, a unit of the first input device 11, the second input device 12, the first localization device 13, the synthesis device 14 and the radio transmission device 51 and a unit of the radio reception device 52 and the output device 15 can be disposed spatially separated. Particularly, according to the fourth headphone apparatus 50, the headphone unit can be configured more compact than the third headphone apparatus 40. Furthermore, the headphone unit can be presented in an entirely wireless form, by employing only the radio reception device 52 as the signal input device to the headphone unit.

Incidentally, similarly to the second headphone apparatus 30, the fourth headphone apparatus 50 is also provided with a second localization device.

Fifth Embodiment

Figure 11:
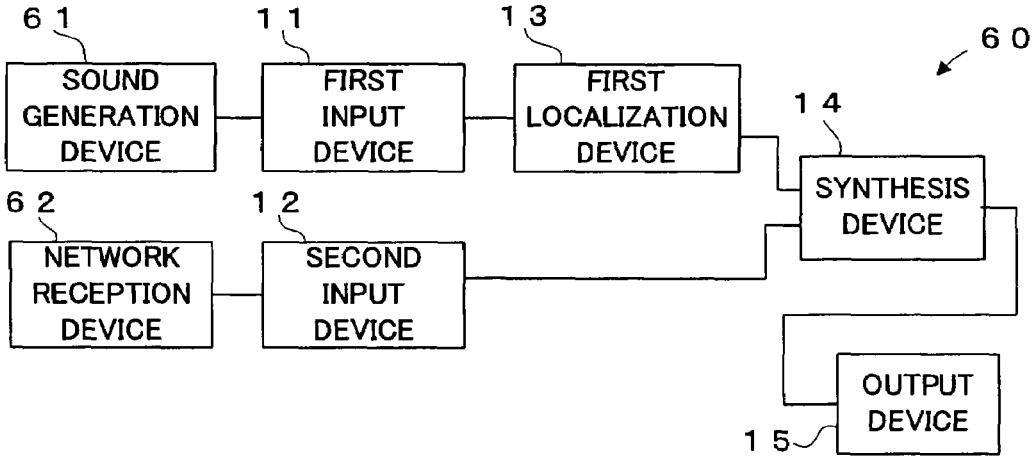
FIG. 11 is a block diagram illustrating a configuration of a headphone apparatus according to a fifth embodiment of the present invention.

The fifth embodiment of the present invention will now be discussed, with reference to FIG. 11. FIG. 11 illustrates a headphone apparatus according to the fifth embodiment of the present invention (hereinafter it is called a "fifth headphone apparatus").

As shown in FIG. 11, the fifth headphone apparatus 60 is provided with a first input device 11, a second input device 12, a first localization device 13, a synthesis device 14 and an output device 15, similarly to the first headphone apparatus 10. The fifth headphone apparatus 60 is further provided with a sound generation device 61 for generating or reproducing sound generation device on the basis of information recorded in a record medium and for supplying it to the first input device 11, and a network reception device 62 for supplying the sound signal, which is received from a communication network, to the second input device 12. Thereby, the sound signal that is generated or reproduced on the basis of the information recorded in the record medium is localized out of the head of the listener by the first localization device 13 and supplied to the synthesis device. On the other hand, the sound signal received from the communication network is supplied from the second input device 12 directly to the synthesis device 14. Then, the synthesis device 14 synthesizes these sound signals and supplies the synthesized sound signal to the output device 15. Therefore, since the sound image of the sound that is reproduced from the recorded information is localized out of the head of the listener and the sound image of the sound received from the communication network is localized in the head of the listener, thereby the listener can clearly distinguish these sounds.

Incidentally, the fifth headphone apparatus 60 may be further provided with a second localization device, similarly to the second headphone apparatus 30. Thereby, the sound image of the sound received from the communication network can be localized not only at a position in the head of the listener, but also at any position different from that of the sound image of the sound reproduced from the record medium. Incidentally, the record medium may be a record disk, a hard disk, a semiconductor memory or the like.

Incidentally, similarly to the second headphone apparatus 30, the fifth headphone apparatus 60 may be also provided with a second localization device.

Sixth Embodiment

Figure 12:
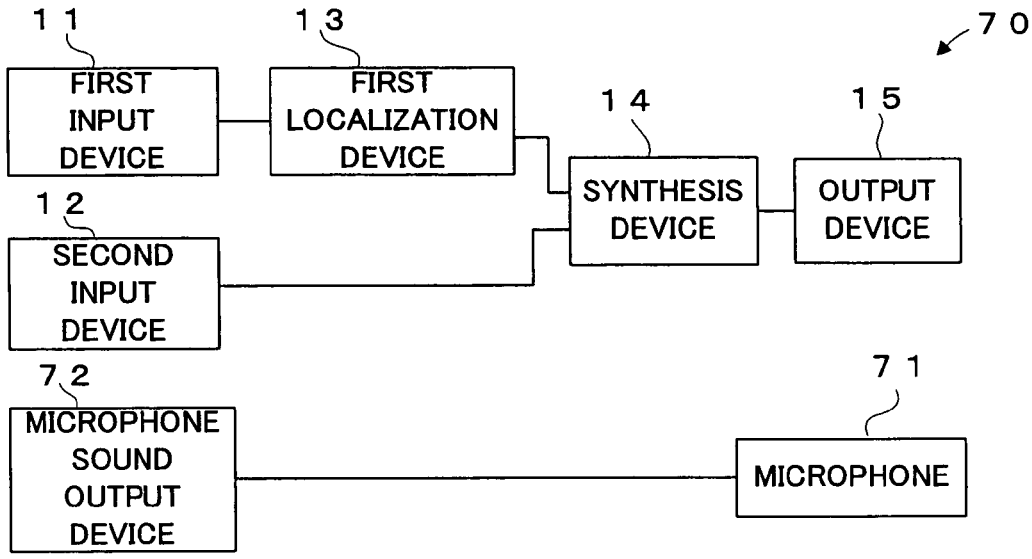
FIG. 12 is a block diagram illustrating a configuration of a headphone apparatus according to a sixth embodiment of the present invention.

The sixth embodiment of the present invention will now be discussed, with reference to FIG. 12. FIG. 12 illustrates a headphone apparatus according to the sixth embodiment of the present invention (hereinafter it is called a "sixth headphone apparatus").

As shown in FIG. 12, the sixth headphone apparatus 70 is provided with a first input device 11, a second input device 12, a first localization device 13, a synthesis device 14 and an output device 15, similarly to the first headphone apparatus 10. The sixth headphone apparatus 70 is further provided with a microphone 71, which is disposed integrally with the output device 15 (e.g., it is connected with the output device 15 in structure), for inputting listener's voice, and a microphone sound output device 72 for outputting externally the sound signal that is outputted from the microphone 71. Thereby, a so-called microphone-attached-headphone can be achieved, and the listener can input his/her voice into the microphone, while listening to sound inputted into the first input device 11 and the second input device 12. A conversation between or among at least two listeners can be achieved, by supplying the sound signal outputted from the microphone sound output device 72 to another or other listeners for example such that said another or other listeners can hear the sound.

Incidentally, similarly to the second headphone apparatus 30, the sixth headphone apparatus 70 may be also provided with a second localization device.

Seventh Embodiment

Figure 13:
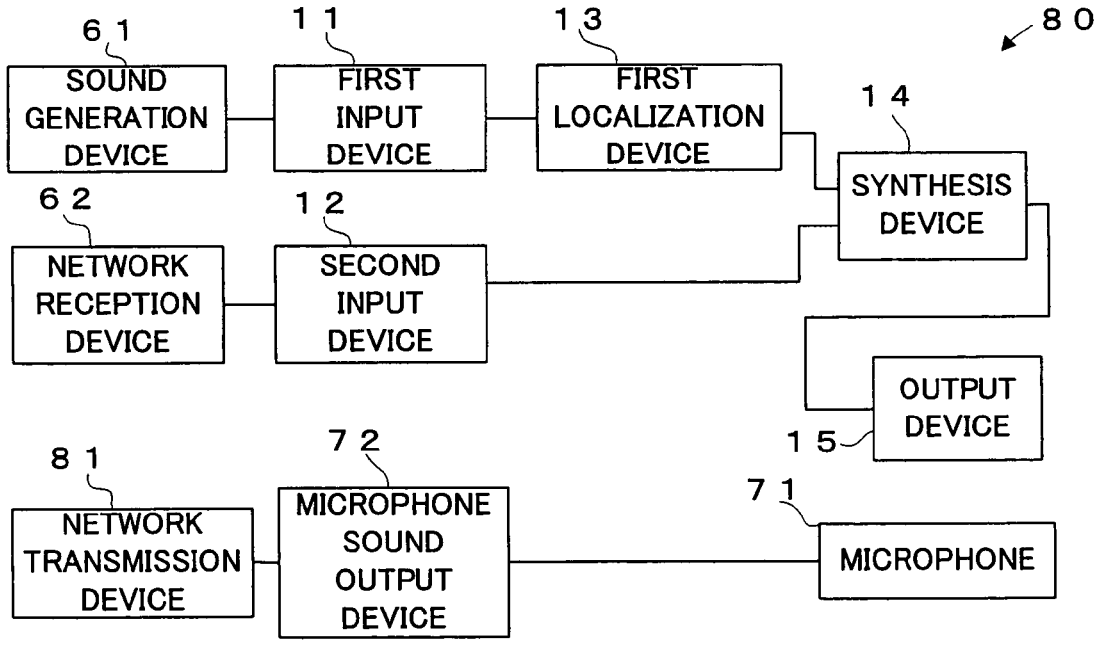
FIG. 13 is a block diagram illustrating a configuration of a headphone apparatus according to a seventh embodiment of the present invention.

The seventh embodiment of the present invention will now be discussed, with reference to FIG. 13. FIG. 13 illustrates a headphone apparatus according to the seventh embodiment of the present invention (hereinafter it is called a "seventh headphone apparatus").

As shown in FIG. 13, a seventh headphone apparatus 80 is provided with a first input device 11, a second input device 12, a first localization device 13, a synthesis device 14, an output device 15, a microphone 71 and a microphone sound output device 72, similarly to the sixth headphone apparatus 70. The seventh headphone apparatus 80 is further provided with a network transmission device 81 for transmitting sound generation device outputted from the microphone sound output device 72 to a communication network. Thereby, the listener's voice is converted to sound generation device via the microphone 71 and then transmitted to the communication network via the microphone sound output device 72 and the network transmission device 81. For example, a conversation between or among at least two listeners who are separated far away to each other can be achieved via the communication network, by supplying the sound signal to another or other listeners via the communication network such that said another or other listeners can hear the sound.

Incidentally, similarly to the second headphone apparatus 30, the seventh headphone apparatus 80 may be also provided with a second localization device.

Eighth Embodiment

A headphone apparatus according to the eighth embodiment of the present invention will now be discussed. The headphone apparatus according to the eighth embodiment of the present invention is that which one of the aforementioned first to seventh headphone apparatuses 10 to 80 is applied to a game machine. In this case, sound generation device to be inputted into the first input device 11 is a game sound, and sound generation device to be inputted into the second input device 12 is voice of the game player.

That is, the game machine, which may be a home-use game machine, is typically connected to a TV and displays an image generated or reproduced on a game program, which is executed in the game machine, and outputs sound to a speaker disposed at the TV. In the case that the headphone apparatus according to any of embodiments of the present invention is applied to such a game machine, however, a connection is established such that the sound signal corresponding to the game sound that is generated or reproduced in the game machine is inputted into the first input device 11, and a connection is established such that the sound signal corresponding to the game players' voice (typically other players such as an opponent in the game or participants in the game) is inputted into the second input device 12.

Thereby, the game sound can be localized out of the head of the listener (a game player), while voice of the opponent or participants in the game is localized in the head of the listener. Therefore, the listener can clearly distinguish the game sound and the voice of the opponent or participants in the game.

Such an application of the headphone apparatus for a game purpose according to the embodiment of the present invention to an on-line game machine with a voice communication function allows the game sound to be localized out of the head of the listener (the game player), and allows the voice of the opponent or participants in the game, which is transmitted via the communication network, to be localized in the head of the listener. Thereby, the listener can clearly recognize the game sound and the voice of the opponent or participants in the game, even if the listener listens to the game sound simultaneously with the voice of the opponent or the like in the game via the headphone. Therefore, for example, even in a situation that a volume level of the game sound that is outputted into the room is limited, it is possible to enjoy a game by means of an on-line game machine with a voice communication function, according to the headphone apparatus for a game purpose of the embodiment of the present invention.

EXAMPLES

Examples of the present invention will now be discussed, with reference to drawings. In the following examples, the headphone apparatus according to the present invention is applied to a game system.

First Example

Figure 14:
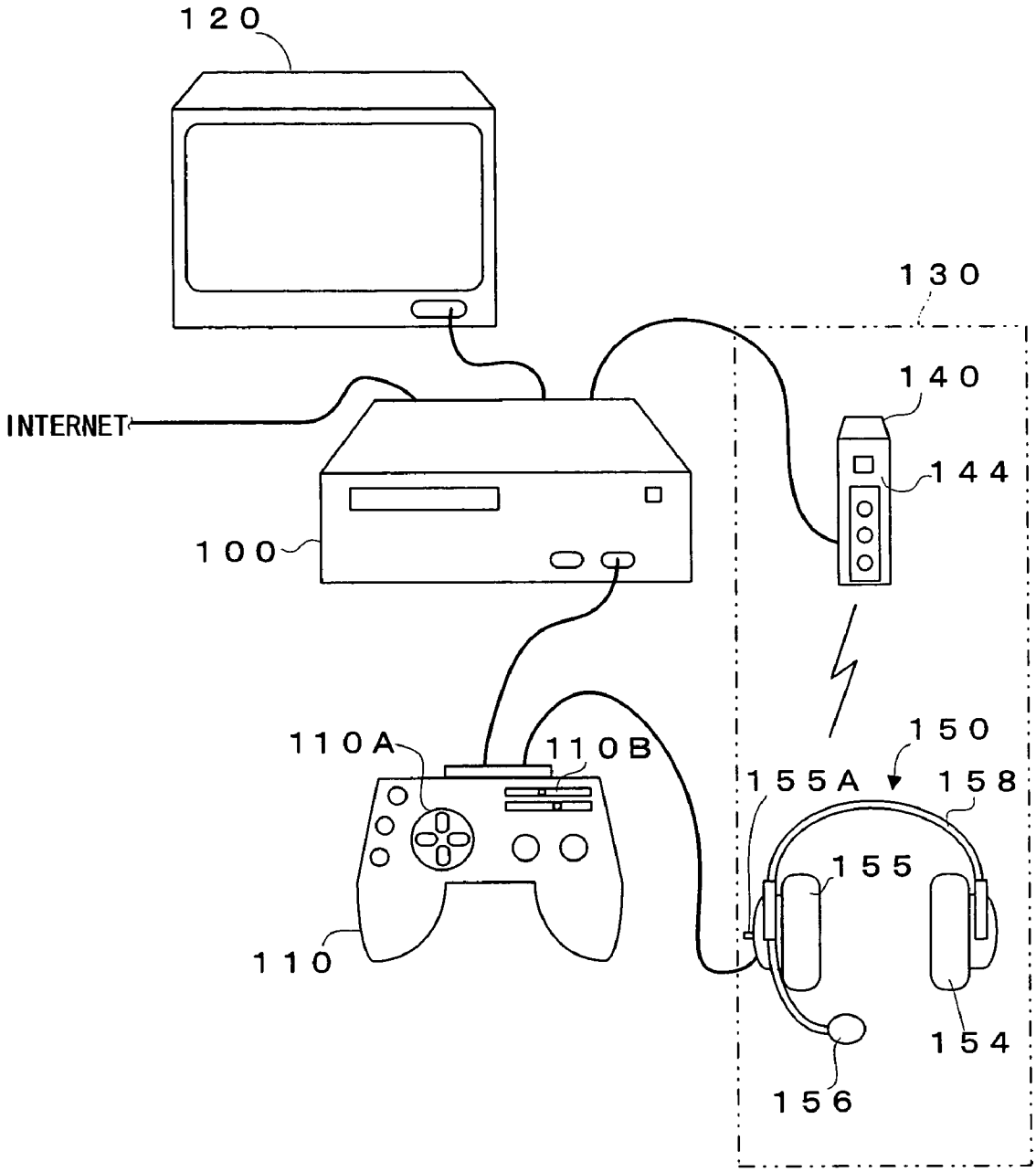
FIG. 14 is a view illustrating an outline of a game system including the headphone apparatus according to a first example of the present invention.

Firstly, a game system including a headphone apparatus according to a first example of the present invention will be discussed. FIG. 14 illustrates the game system including the headphone apparatus according to the first example of the present invention. As shown in FIG. 14, the game system is provided with a game machine 100, a game controller 110, a television 120 and a headphone apparatus 130.

The game machine 100 is an on-line game machine with a voice communication function. The game machine 100 may include a disk drive, a CPU, a memory, a decoder, an internet communication interface and the like. The game machine 100 reads and runs (or reproduces) video information or the like corresponding to a game image and audio information corresponding to game sound, game program or the like that is recorded in a DVD-ROM or the like. In turn, a video output terminal of the game machine 100 is connected to a video input terminal of the television to display the reproduced image on a screen of the television 120.

Furthermore, the Internet communication interface of the game machine 100 is connected to Internet. Thereby, the game machine 100 can transmit and receive the information or the like about the game, bidirectionaly via Internet. Particularly, the game machine 100 can transmit sound generation device of player's voice to Internet, and receive sound generation device of voice of another or other players (e.g. an opponent or other participants in the game) via Internet, who enjoy the game with another or other on-line game machines having a voice communication function that are connected respectively to Internet. Hereinbelow the player of the game machine 100 is called a "player A", and another player who enjoys the game with another on-line game machine with a voice communication function that is connected to Internet (e.g., an opponent) is called a "player B".

Furthermore, the game sound output terminal of the game machine 100 is connected to a signal processing unit 140 of the headphone apparatus 130. Thereby, the game machine 100 outputs the sound signal corresponding to the reproduced game sound to the signal processing unit 140. In this example, the game machine 100 reproduces "five-channel surround game sound" and outputs the corresponding sound signal in a digital signal to the signal processing unit 140.

Furthermore, the controller 110 is connected to a controller terminal of the game machine 100. The controller 110 has multiple switches 110A and multiple slider tabs 110B. If the "player A" operates these switches 110A or slider tabs 110B, a control signal corresponding to the operation is supplied from the controller 110 to the game machine 100.

Furthermore, a connection between the game machine 100 and the controller 110 includes not only such a line to transmit/receive the control signal, but also a line to transmit/receive the sound signal. The game machine 100 outputs the sound signal of a voice of the "player B", which is received via Internet, to a headphone unit 150 of the headphone apparatus 130 via the controller 110. Furthermore, the game machine 100 receives the sound signal of a voice of the "player A", which is inputted from a microphone 156 of the headphone unit 150, via the controller 110. Then, the game machine 100 transmits the received sound signal to Internet via the Internet communication interface. The transmitted voice of the "player A" reaches the "player B" who enjoys the game at that time. Thereby, the "player A" can make a conversation (a voice communication) with the "player B", while enjoying the game.

The sound signals of a voice of the "player A" or a voice of the "player B" are monaural sound signals. Furthermore, the sound signal of the voice of the "player B" is a digital signal when it is received via Internet. The game machine 100 supplies the sound signal in this digital signal to the headphone unit 150 via the controller 110. On the other hand, the sound signal of the voice of the "player A" is an analog voice when it is outputted from the microphone 156, but it is converted to a digital signal inside of the headphone unit 150 to be inputted into the game machine 100 via the controller 110. The game machine 100 transmits the sound signal in a form of the digital signal to Internet.

Next, the headphone apparatus 130 will be discussed. As shown in FIG. 14, the headphone apparatus 130 includes the signal processing unit 140 and the headphone unit 150. The signal processing unit 140 and the headphone unit 150 are spatially separated from each other. Nevertheless, the sound signal can be transmitted/received via infrared radiation between both units. Various circuits, devices or the like of the signal processing unit 140 is accommodated in a box-like housing 144. On the other hand, the headphone unit 150 is provided with a left speaker unit 154, a right speaker unit 155, a microphone 156, a headband 158 connecting both speaker units 154 and 155 or the like. The microphone 156 is disposed integrally with the speaker units 154 and 155. Furthermore, various circuits, devices or the like may be disposed inside of the speaker units 154 and 155, for example.

Figure 15:
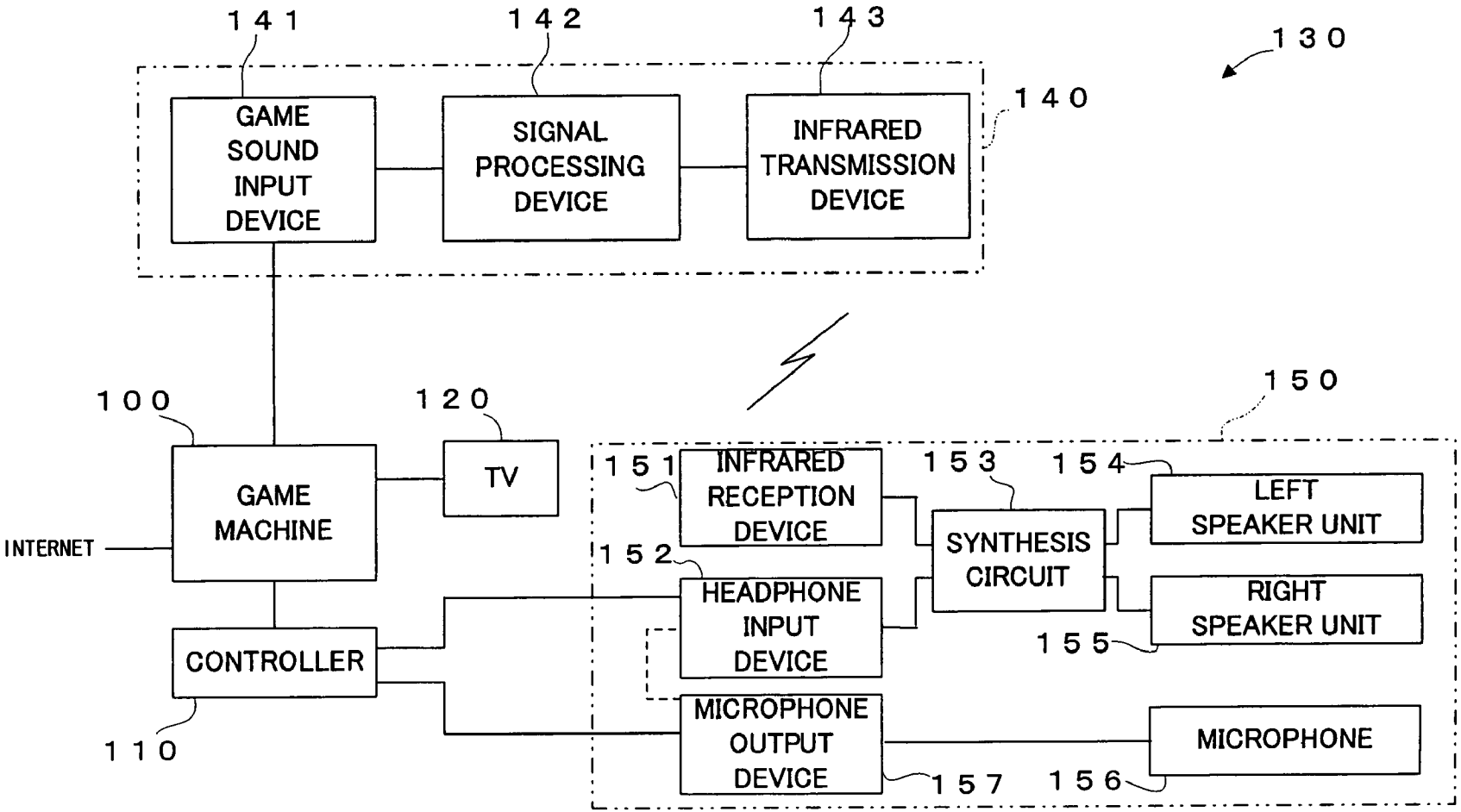
FIG. 15 is a block diagram illustrating the configuration of the headphone apparatus according to the first example of the present invention, with a game machine connected thereto.

FIG. 15 illustrates a detail construction of the signal processing unit 140 and the headphone unit 150, with a connection to the game machine 100. As shown in FIG. 15, the signal processing unit 140 includes a game sound input device 141, a signal processing device 142 and an infrared transmission device 143.

The game sound input device 141 is a connection circuit for receiving sound generation device of the game sound outputted from a game sound output terminal of the game machine 100 and supplying the sound signal to the signal processing device 142. The sound signal of the game sound outputted from the game sound output terminal of the game machine 100 is a five-channel digital sound. Therefore the game sound input device 141 is provided with a connection terminal for inputting a digital signal. The game sound input device 141 supplies the inputted sound signal of the game sound to the signal processing unit 142, in a form of the five-channel digital signal.

The signal processing unit 142 is a digital signal processing circuit for localizing sound images of the five-channel digital sound signal at predetermined positions out of the head of the "player A". More specifically, the signal processing device 142 firstly receives the sound signal of the game sound supplied from the game sound input device 141. Next, the signal processing device 142 sets the out-of-head sound localization of the five-channel game sound, so as to localize the first channel at a front-left position of the "player A", the second channel at a center front position, the third channel at a front-right position, the fourth channel at a left side position and the fifth channel at a right side position. Such a signal processing circuit may be embodied with ten filters for which filter coefficients are predetermined on the basis of appropriate transfer functions to perform the sound localization, as mentioned above. Furthermore, these filters may be made of a DSP. Next, the signal processing device 142 splits/integrates the sound signal of the game sound, for which an out-of-head sound localization is set, into two-channel lines so as to perform the out-of-head sound localization, and supplies the two-channel sound signal split/integrated to the infrared transmission device 143 in a form of the digital signal.

The infrared transmission device 143 is a wireless transmitter employing an infrared communication. The infrared transmission converts the sound signal of the game sound, which is supplied from the signal processing device 142, into an infrared signal and transmits the infrared signal to the headphone unit 150.

The headphone unit 150 is provided with an infrared reception device 151, a headphone input device 152, a synthesis circuit 153, a left speaker unit 154, a right speaker unit 155, a microphone 156 and a microphone output device 157.

The infrared reception device 151 is a wireless receiver employing an infrared communication. The infrared reception device 151 receives the infrared signal, which is transmitted from the infrared transmission device 143, and converts the infrared signal to reproduce the sound signal of the game sound. Furthermore, the infrared reception device 151 supplies the sound signal of the game sound to the synthesis circuit 153 in a form of the two-channel digital signal.

The headphone input device 152 is a connection circuit for receiving sound generation device of a voice of the "player B", which is supplied from the game machine 100 via the controller 110, and supplying it to the synthesis circuit 153. The sound signal of the voice of the "player B", which is supplied from the game machine 100, is a digital monaural signal. Therefore, the headphone input device 152 is provided with a connection terminal for inputting a digital signal. The headphone input device 152 supplies the sound signal of the voice of the "player B" to the synthesis circuit 153 in a form of the monaural digital signal.

The synthesis circuit 153 is a digital signal synthesis circuit for synthesizing the sound signal of the game sound supplied from the infrared reception device 151 and the sound signal of a voice of the "player B" supplied from the headphone input device 152. More specifically, since the sound signal of the game sound is of the two-channel signal, the sound signal of a voice of the "player B" is of the monaural one-channel signal, and the output from the synthesis circuit 153 is of the two-channel signal, the synthesis circuit 153 splits the sound signal of the voice of the "player B" into two channels and adds the split each sound signal to each channel of the sound signal of the game sound. Then, the resulting two-channel synthesized sound signal is converted from digital to analog and outputted to the left speaker unit 154 and the right speaker unit 155, respectively.

The left speaker unit 154 outputs the sound signal of one channel supplied from the synthesis circuit 153. The right speaker unit 155 outputs the sound signal of another channel supplied from the synthesis circuit 153. Thereby, the sound signal reaches the right ear and the left ear of the "player A", respectively.

The microphone 156 is for inputting a voice of the "player A". The microphone output device 157 converts the sound signal of the voice of the "player A", which is supplied via the microphone 156, from analog to digital and supplies it to the game machine 100 via the controller 110. Incidentally, it is also possible to add a line for supplying the sound signal of a voice of the "player A", which is outputted from the microphone output device 157, to the headphone input device 152.

Figure 16:
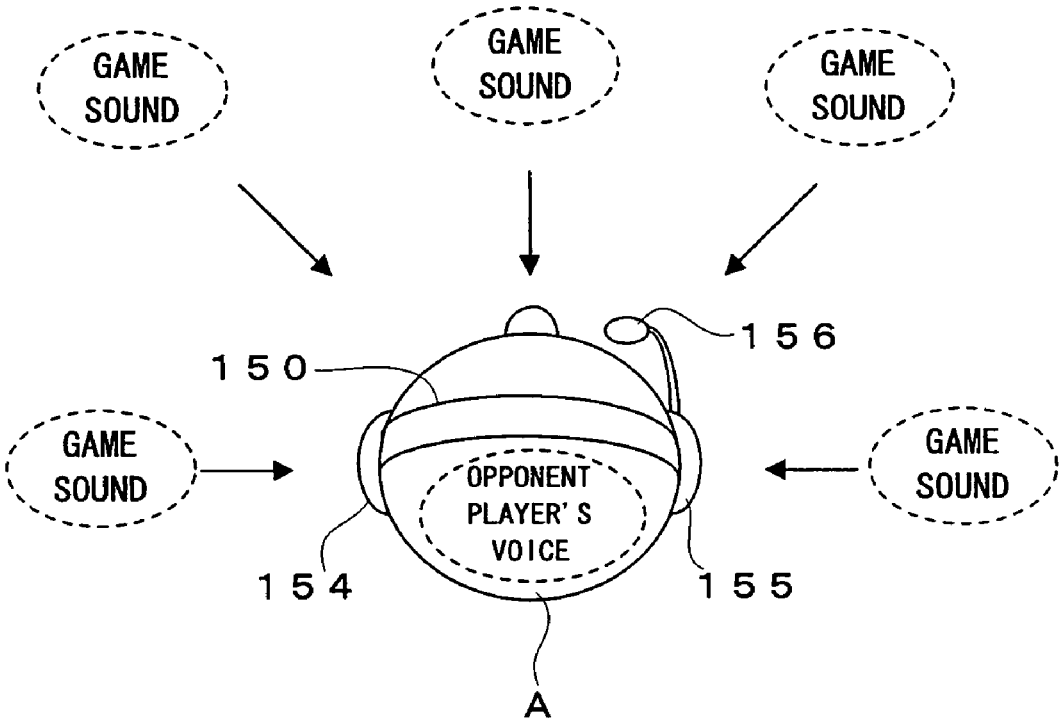
FIG. 16 is an explanation view illustrating a situation that sound images of game sound is localized separately from a sound image of an opponent player's voice.

According to the headphone apparatus 130 having such a configuration, as shown in FIG. 16, since the signal processing device 142 sets the out-of-head sound localization for the game sound, the game sound is localized at a front-left position, a center front position, a front-right position, a left side position and a right side position of the "player A" wearing the headphone unit 150. On the other hand, since the voice of the "player B" is just split in two-channels to be outputted as the monaural signal, without being subjected to any out-of-head sound localization, it is naturally localized in the head of the "player A".

Therefore, the "player A" can clearly distinguish the game sound and a voice of the "player B", even if both sound are outputted simultaneously from the speaker units 154 and 155 of the headphone unit 150. Furthermore, since the "player A" listens to the game sound and the voice of the "player B" via the headphone 150, leakage of the sound to the ambient can be avoided, even if it is on full blast or the like.

Furthermore, according to the headphone apparatus 130, since the sound images of the sound signal of the game sound are localized at five positions around the "player A", it is possible to reproduce a sound field of the five-channel game sound, which is to be reproduced originally by means of five speakers, by means of the headphone unit 150 basically made in a two-channel system. Thereby, the "player A" has an illusion as if the game sound is outputted from five speakers to the ambient (inside of a room or the like), with wearing the headphone unit 150.

Furthermore, the present invention is advantageous as follows, because the headphone apparatus 130 is spatially separated into the signal processing unit 140 and the headphone unit 150. That is, in an arrangement that electrical power for the signal processing unit 140 is supplied from a receptacle, a wall socket, a wall outlet or the like in the house, while electric power for the headphone unit 150 is supplied from an electric cell, a lifetime of the cell used for the headphone unit 150 can be elongated by disposing the signal processing device 142 requiring relatively high power consumption in the signal processing unit 140. Furthermore, by disposing the signal processing device 142 or the like in the signal processing unit 140, a lighter and smaller headphone unit 150 can be presented.

Furthermore, according to the headphone unit 130, since the headphone unit 150 is provided integrally with the microphone 156 or the like, the "player A" can input his/her voice into the game machine 100, while operating the controller 110 with both hands. Thereby, a voice communication during the game can be achieved.

Second Example

The second example of the present invention will now be discussed, with reference to FIG. 17. Incidentally, in the following second example, the components same as those of the first example carry the same numerals, whose explanation is omitted hereinbelow.

Figure 17:
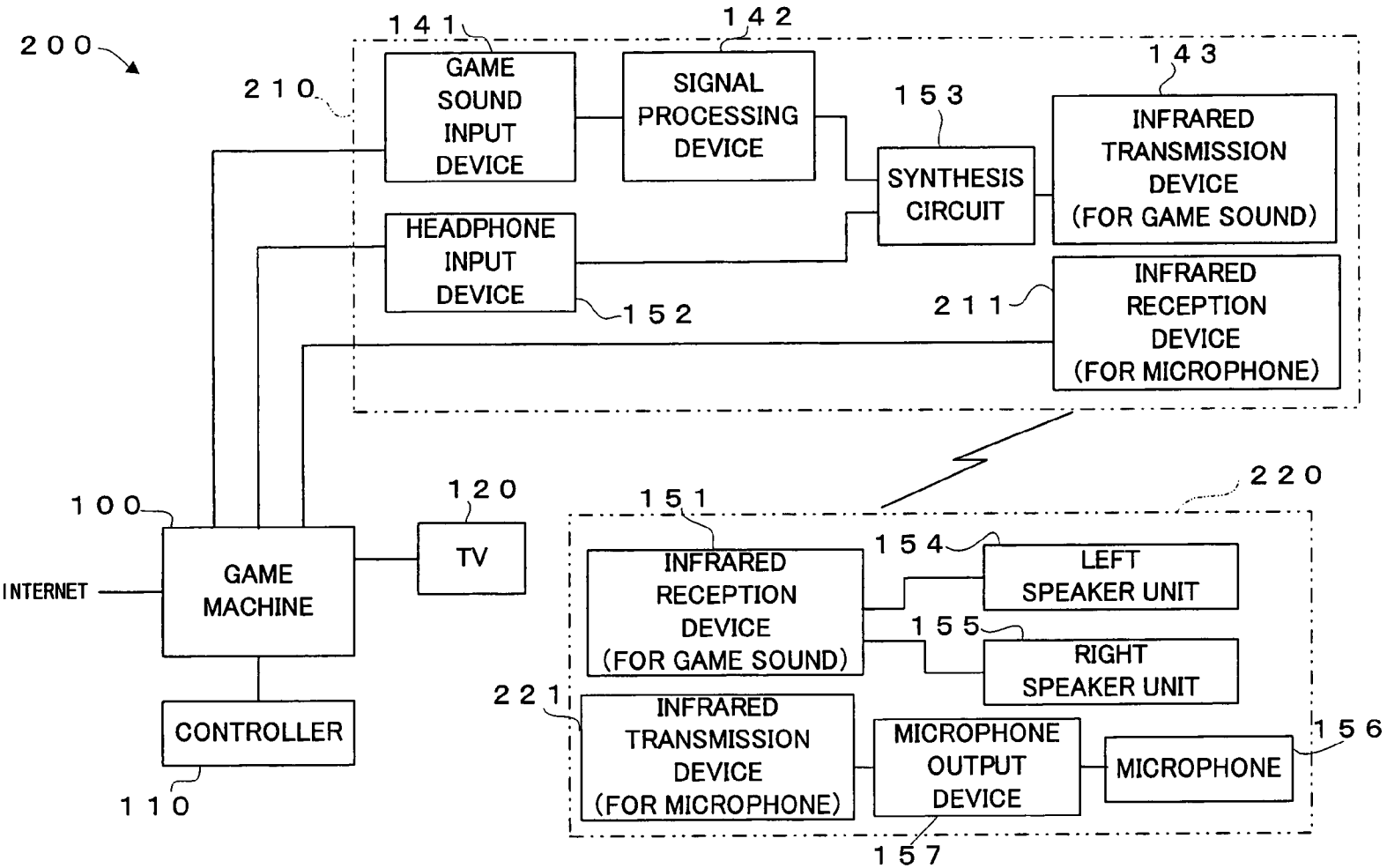
FIG. 17 is a block diagram illustrating the configuration of the headphone apparatus according to a second example of the present invention, with a game machine connected thereto.

FIG. 17 illustrates a headphone apparatus according to the second example of the present invention, with a relationship to the game machine 100 or the like. As shown in FIG. 17, the headphone apparatus 200 according to the second example includes a signal processing unit 210 and a headphone unit 220. The signal processing unit 210 and the headphone unit 220 are spatially separated from each other. Nevertheless, it is possible to transmit and receive sound generation device between both units by means of infrared radiation. With regard to the profiles or outlooks of the signal processing unit 210 and the headphone unit 220, each of them is almost the same respectively as each of the signal processing unit 140 and the headphone unit 150, as shown in FIG. 14, but the headphone unit 220 is smaller and lighter than the headphone unit 150. Furthermore, the headphone unit 220 has a fully wireless design, while the headphone unit 150 is connected to the controller 110 via a line, as shown in FIG. 14.

As shown in FIG. 17, the signal processing unit 210 is provided with a game sound input device 141, a signal processing device 142, a synthesis circuit 153, an infrared transmission device 143 for the game sound, a headphone input device 152 and an infrared reception device 211 for a microphone. These elements excluding the infrared reception device 211 are the same as the headphone apparatus 130 according to the first example in their substantial inner construction excluding their spatially arrangement.

The infrared reception device 211 for the microphone is a wireless receiver employing an infrared communication system. The infrared reception device 211 receives an infrared signal corresponding to the sound signal of the voice of the "player A" that is transmitted from the headphone unit 220, and converts the infrared signal into the sound signal to be supplied to the game machine 100.

On the other hand, the headphone unit 220 is provided with an infrared reception device 151 for the game sound, a left speaker unit 154, a right speaker unit 155, a microphone 156, a microphone output device 157 and an infrared transmission device 221 for a microphone. These components excluding the infrared transmission device 221 are the same as the headphone apparatus 130 according to the first example in their substantial inner constructions excluding their spatially arrangement.

The infrared transmission device 221 for the microphone is a wireless transmitter employing an infrared communication system. The infrared transmission device 221 converts the sound signal of the voice of the "player A", which is inputted via the microphone 156 and the microphone output device 157, into an infrared signal to be transmitted to the signal processing unit 210.

In the headphone apparatus 200, not only the sound signal of the game sound outputted from the game machine 100 but also the sound signal of a voice of the "player B" is supplied. Furthermore, the sound signal, which is synthesized at the synthesis circuit 153 in the signal processing unit 210, is converted into an infrared signal at the infrared transmission device 143 and transmitted to the headphone unit 220. Then, the infrared signal, which is transmitted from the signal processing unit 210 in the headphone unit 220, is received at the infrared reception device 151, and converted into sound generation device to be outputted to the speaker units 154 and 155.

Furthermore, according to the headphone apparatus 200, the sound signal of a voice of the "player A" is also converted into an infrared signal at the infrared transmission device 221 in the headphone unit 220 and transmitted to the signal processing unit 210. Then, in the signal processing unit 210, the infrared signal is received at the infrared reception device 211 and converted to sound generation device to be outputted to the game machine 100.

According to the headphone apparatus 200 having such a construction, it is possible to localize sound images of the game sound at positions out of the head of the "player A", while localize a sound image of a voice of the "player B" voice at a position in the head of the "player A", similarly to the headphone apparatus 130 according to the first example. Thus, by localizing the sound images of the game sound at the positions different from the position at which the sound image of a voice of the "player B" is localized, the "player A" can clearly distinguish the game sound and a voice of the "player B", even if both sound are outputted from the speaker units 154 and 155 of the headphone unit 150.

Particularly according to the headphone apparatus 200, owing to a construction in that the headphone unit 220 is provided with the infrared reception device 151 and the infrared transmission device 221 to input the game sound and output a voice of the "player A" via the wireless communication, the entirely wireless design of the headphone unit can be achieved. Thereby, it becomes easier for the "player A" to move.

Furthermore, according to the headphone apparatus 200, a smaller, lighter, and more power-thrifty headphone unit 200 can be presented, since circuits or the like to be disposed at the headphone unit 200 are reduced in their numbers.

Incidentally, the headphone apparatus 130 may further include a change device for changing positions of the sound images of the game sound or a voice of the "player B". For example, a control tab may be disposed on the housing 144 of the signal processing unit 140, such that filter coefficients predetermined for each filter in the signal processing device 142 can be modified, and the sound images of the game sound can be controlled so as to move in a direction away from the "player A" or a direction approaching to the "player A". The similar arrangement is possible for the headphone apparatus 200.

Alternatively, the headphone apparatus 130 may further include a volume control device for controlling volume of the game sound or a voice of the "player B". For example, a volume control circuit may be disposed between the output of the signal processing device 142 and the input of the synthesis circuit 153, and a volume control tab that is connected to the volume control circuit may be disposed on the housing 144 of the signal processing unit 140 or at the speaker units 154 and 155 of the headphone 150. For example, a tab 110B of the controller 110 or a tab 155A disposed at the right speaker unit 155 may be used as the volume control tab. The similar arrangement is possible for the headphone apparatus 200.

The headphone unit 150 is not limited to a unit arranged so that the speaker unit 154 is connected to the speaker unit 155 via the headband 158. For example, a unit arranged so that a band to connect the speaker units is disposed behind the neck, or a unit of earphone type arranged so that the listener wears directly each speaker unit without a band to connect the speaker units is also possible. The similar arrangement is possible for the headphone unit 220.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2002-369837 filed on Dec. 20, 2002 including the specification, claims, drawings and summary is incorporated herein by reference in its entirety.

What is claimed is:

1. A headphone apparatus comprising:

two or more input devices including at least i) a first input device to receive a first sound signal comprising a first sound image and ii) a second input device to receive a second sound signal comprising a second sound image from a sound generation device, the second sound image differing in application from the first sound image;

a first localization device connected to an output of the first input device, the first localization device for receiving the first sound signal from the first input device and for localizing the first sound image of the first sound signal at one or more positions out of a head of a listener;

a second localization device connected to an output of the second input device, the second localization device for receiving the second sound signal from the second input device and for localizing the second sound image of the second sound signal at one or more positions in the head of the listener;

a synthesis device connected to the output of the first localization device and to the output of the second localization device, the synthesis device for synthesizing a synthesized sound signal from the first sound image localized by said first localization device and the second sound image localized by said second localization device;

an output device for outputting the synthesized sound signal synthesized by said synthesis device; and a radio transmission device and a radio reception device connecting the synthesis device to the output of the first localization device, the radio transmission device for transmitting the first sound image localized by said first localization device, and the radio reception device for receiving the first sound image transmitted from said radio transmission device via a radio communication and for supplying the first sound image to said synthesis device, wherein said first sound image is not inputted into said second input device and said second sound image is not inputted into said first input device.

2. The headphone apparatus according to claim 1, wherein said first localization device localizes the first sound image of the first sound signal at two positions out of the head of the listener.

3. The headphone apparatus according to claim 1, wherein said first localization device localizes the first sound image of the first sound signal at five or more positions out of the head of the listener.

4. The headphone apparatus according to claim 1, wherein said first localization device localizes the first sound image of the first sound signal at two positions which are out of the head of the listener, a first of said two positions being a front-left position of the listener, and a second of said two positions being a front-right position of the listener.

5. The headphone apparatus according to claim 1, wherein said first localization device localizes the first sound image of the first sound signal at five positions which are out of the head of the listener, a first of said five positions being a front-left position of the listener, a second of said five positions being a center front position of the listener, a third of said five positions being a front-right position of the listener, a fourth of said five positions being a left side position of the listener, and a fifth of said five positions being a right side position of the listener.

6. The headphone apparatus according to claim 1, wherein said first localization device is a digital signal processor (DSP).

7. The headphone apparatus according to claim 1, wherein said second localization device is a digital signal processor (DSP).

8. The headphone apparatus according to claim 1, wherein said output device is a speaker unit configured to be worn on ears of the listener.

9. The headphone apparatus according to claim 1, wherein said first input device, said first localization device and said radio transmission device form a signal processing unit, said second input device, said radio reception device, said synthesis device and said output device form a headphone unit, and said signal processing unit and said headphone unit are spatially separated.

10. The headphone apparatus according to claim 1, wherein, the application of the first sound image of the first sound signal to be inputted into said first input device is a game sound, and the application of the second sound image of the second sound signal to be inputted into said second input device is a game player's voice.

11. The headphone apparatus according to claim 1, further comprising:

a sound generation device f or generating or reproducing the first sound signal on the basis of information recorded in a record medium and for supplying the first signal to said first input device; and a network reception device for supplying the second sound signal received from a communication network to said second input device.

12. A headphone apparatus comprising:

two or more input devices including at least i) a first input device to receive a first sound signal comprising a first sound image and a second input device to receive a second sound signal comprising a second sound image from a sound generation device, the second sound image differing in application from the first sound image;

a first localization device connected to an output of the first input device, the first localization device for receiving the first sound signal from the first input device and for localizing the first sound image of the first sound signal at one or more positions out of a head of a listener;

a second localization device connected to an output of the second input device, the second localization device for receiving the second sound signal from the second input device and for localizing the second sound image of the second sound signal at one or more positions in the head of the listener;

a synthesis device connected to the output of the first localization device and to the output of the second localization device, the synthesis device for synthesizing a synthesized sound signal from the first sound image localized by said first localization device and the second sound image localized by said second localization device;

an output device for outputting the synthesized sound signal synthesized by said synthesis device; and a radio transmission device and a radio reception device connecting the output device to the output of the synthesis device, the radio transmission device for transmitting the synthesized sound signal synthesized by said synthesis device, and the radio reception device for receiving the synthesized sound signal transmitted from said radio transmission device via a radio communication and for supplying the synthesized sound signal to said output device, wherein said first sound image is not inputted into said second input device and said second sound image is not inputted into said first input device.

13. The headphone apparatus according to claim 12, wherein, said first input device, said second input device, said first localization device, said synthesis device and said radio transmission device form a signal processing unit, said radio reception device and said output device form a headphone unit, and said signal processing unit and said headphone unit are spatially separated.

14. A headphone apparatus comprising:

two or more input devices including at least i) a first input device to receive a first sound signal comprising a first sound image and ii) a second input device to receive a second sound signal comprising a second sound image from a sound generation device, the second sound image differing in application from the first sound image;

a first localization device connected to an output of the first input device, the first localization device for receiving the first sound signal from the first input device and for localizing the first sound image of the first sound signal at one or more positions out of a head of a listener;

a second localization device connected to an output of the second input device, the second localization device for receiving the second sound signal from the second input device and for localizing the second sound image of the second sound signal at one or more positions in the head of the listener;

a synthesis device connected to the output of the first localization device and to the output of the second localization device, the synthesis device for synthesizing a synthesized sound signal from the first sound image localized by said first localization device, the second sound image localized by said second localization device;

an output device for outputting the synthesized sound signal synthesized by said synthesis device;

a microphone for inputting a voice of said listener, the microphone disposed integrally with said output device; and a microphone audio output device, connected to said microphone, for outputting a microphone sound signal outputted from said microphone to an ambient, wherein said first sound image is not inputted into said second input device and said second sound image is not inputted into said first input device.

15. The headphone apparatus according to claim 14, further comprising:

a network transmission device for transmitting the microphone sound signal to a communication network.

16. The headphone apparatus according to claim 12, wherein, the application of the first sound image of the first sound signal to be inputted into said first input device is a game sound, and the application of the second sound image of the second sound signal to be inputted into said second input device is a game player's voice.

17. The headphone apparatus according to claim 14, wherein, the application of the first sound image of the first sound signal to be inputted into said first input device is a game sound, and the application of the second sound image of the second sound signal to be inputted into said second input device is a game player's voice.

* * * * *